United States Patent [19]

Kobryn

[11] Patent Number: 4,736,679

[45] Date of Patent: Apr. 12, 1988

[54] BAND PRINTER AND PRINT BAND

[75] Inventor: Ronald J. Kobryn, Longwood, Fla.

[73] Assignees: L. James Hubbard; Virginia M. Hubbard

[21] Appl. No.: 42,606

[22] Filed: Apr. 22, 1987

Related U.S. Application Data

[63] Continuation of Ser. No. 858,833, Apr. 29, 1986, abandoned, which is a continuation of Ser. No. 763,155, Aug. 7, 1985, abandoned.

[51] Int. Cl.[4] ..... B41J 3/12

[52] U.S. Cl. ..... 101/93.04; 101/93.14; 101/111

[58] Field of Search ..... 101/93.04, 93.09, 93.14, 101/93.15, 93.16, 111

[56] References Cited

U.S. PATENT DOCUMENTS

| | | | |
|---|---|---|---|
| 3,774,531 | 11/1973 | Hansen | 101/111 X |
| 3,791,292 | 2/1974 | Soderstrom | 101/111 |
| 4,075,945 | 2/1978 | Bienholz | 400/146 X |

*Primary Examiner*—Paul T. Sewell

*Attorney, Agent, or Firm*—Martin LuKacher

[57] ABSTRACT

Printing apparatus which provides full font character and dot matrix printing with an endless band having full font printing elements and dot printing elements spaced successively on the band. In order to provide the proper spacing of the characters, either formed with the full font elements or the dot matrix elements and to provide for graphics printing capabilities, a plurality of hammers are movably mounted on a shuttle which reciprocates along the print line. A plurality of fixed armatures selectively impact the hammers as they are moved. Predetermined, incremental hammer movements provide standard, compressed or expanded horizontal character and/or dot spacing.

15 Claims, 4 Drawing Sheets

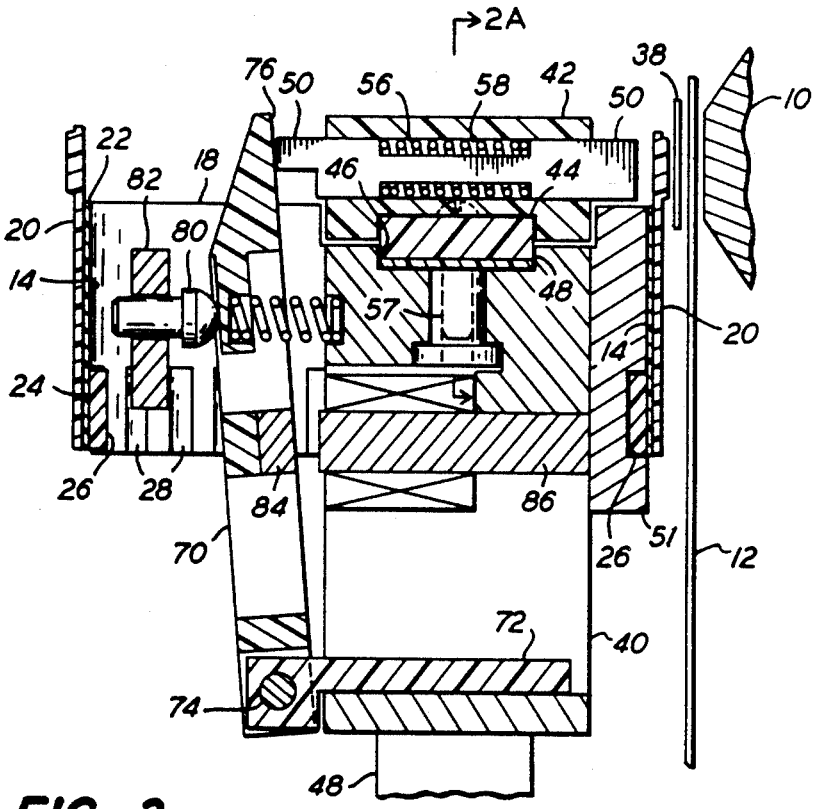
FIG. 2
FIG. 3
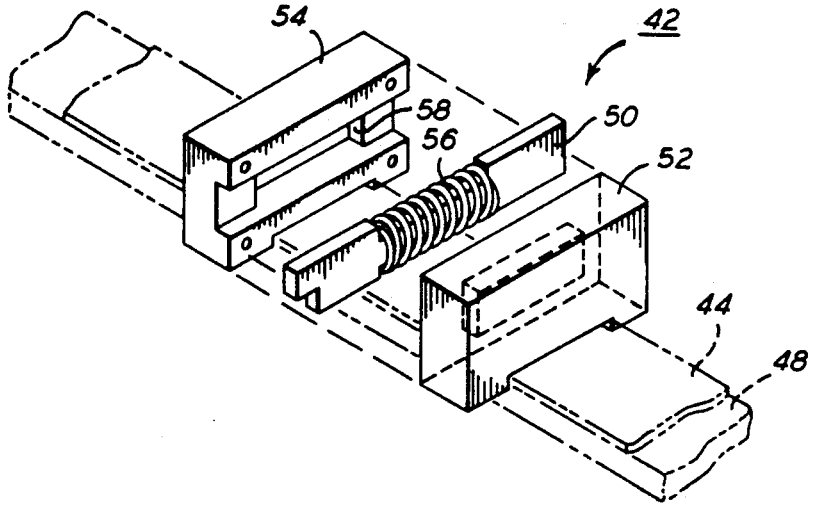

FIG. 2A
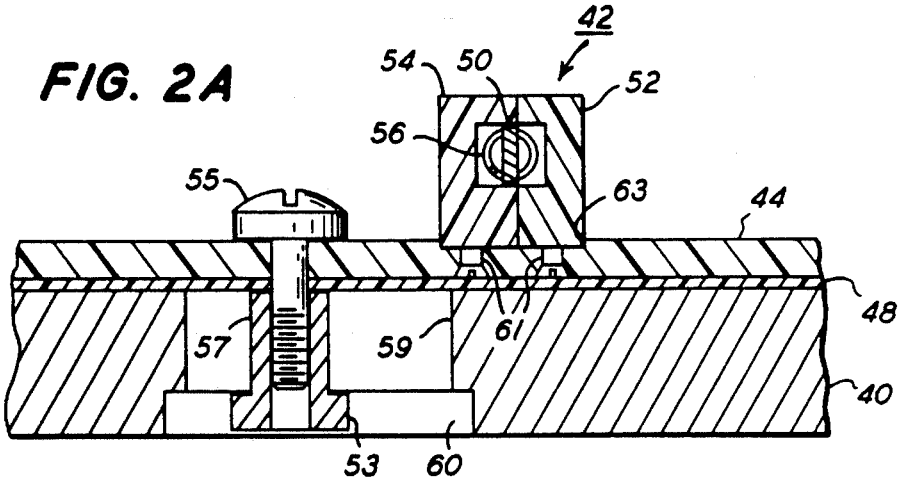
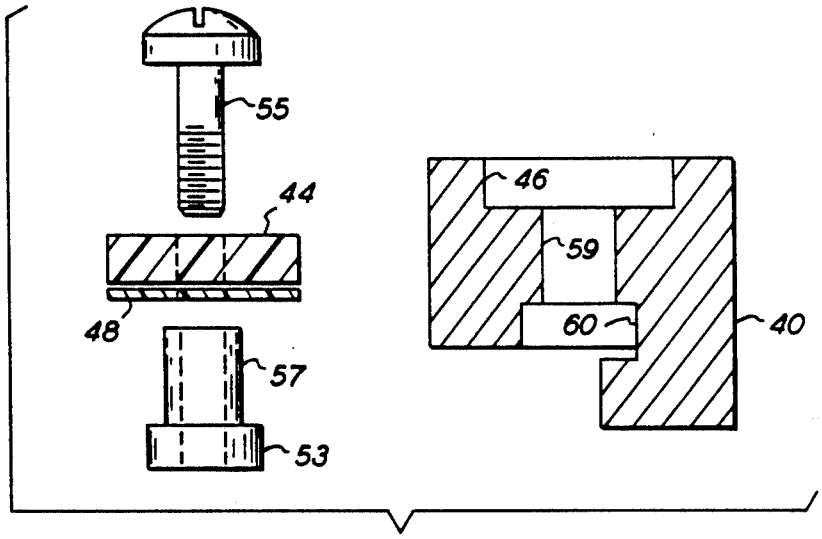
FIG. 2B
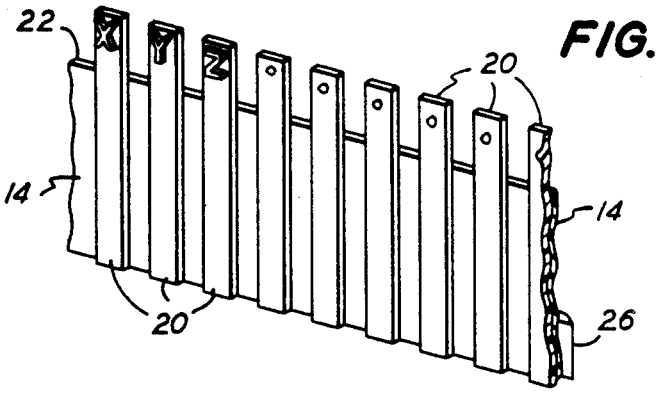
FIG. 4

BAND PRINTER AND PRINT BAND

This is a continuation of application Ser. No. 858,833, filed Apr. 29, 1986 (now abandoned) which is a continuation of application Ser. No. 763,155, filed Aug. 7, 1985 (now abandoned).

DESCRIPTION

The present invention relates to printing apparatus, and particularly to a band printer that can produce both dot matrix characters in various character types and sizes and also graphics, as well as full font characters.

The present invention is especially suitable for use in providing a hybrid dot matrix and full font character printer which is not limited to the specific characters which can be printed by the full font type faces, but rather can form other and different characters, for example characters of a foreign language, and even graphics utilizing dot matrix printing elements which are contained on the same print band. The invention also provides features which may be used in the design of printing mechanisms, especially in the arrangement, assembly and motivation of hammers and armature assemblies. The invention is, therefore, applicable generally in various forms of printing apparatus, as well as in the above-mentioned, hybrid full font, dot matrix band printer.

Band printers of various types have been disclosed and are presently available on the commercial market. Most utilize a print band of metal or metal composite material. The print band contains one or more groups of full font character printing elements (see, for example, U.S. Pat. No. 3,697,958 issued Oct. 10, 1972 for Font Selecting System). It has also been proposed to use print bands which do not carry full font character elements, but rather carry dot printing elements. U.S. Pat. Nos. 4,428,285 issued Jan. 31, 1984 and 4,448,123 issued May 15, 1984 are recent examples of such dot band printers.

Band printers generally operate by impacting the printing elements on the fly when the elements are aligned in different positions along the printing line. Usually a separate hammer is provided for each printing position along the line; an 80-column printer, for example utilizing 80 hammers. It has been proposed however, to utilize fewer hammers than printing positions and even to move the hammers in their entirety along the printing line (see U.S. Pat. No. 3,188,947 issued June 15, 1965 for Platen Actuating Means In High Speed Belt Printer and U.S. Pat. No. 3,220,343 issued Nov. 30, 1965 for High Speed Printers With Column Spanning Hammers). Such systems involve motivation of an entire bank of hammer assemblies as well as complex electronics in order to maintain the necessary synchronism between hammer movement both along the printing line and into impact with the printing elements thereby sacrificing some of the high speed capabilities of band printers and increasing their cost. It has also been proposed to provide different pitch (spacing) relationship of the hammers in the mechanism from the pitch of the character elements on the belt in order to pack more characters on the belt, but sacrificing complexity and some print speed (see British Patent No. 1,011,388 published Nov. 24, 1965).

It is a principal feature of this invention to provide an improved high speed printer of the band type wherein full font and dot matrix printing can be carried out in the same unit.

It is an ancillary feature of the invention to provide an improved band printer which may effect printing at different pitch positions thus enabling the use of fewer hammer assemblies and providing compatibility in a printer which can be fabricated at reasonable cost for providing both full font and dot matrix printing in the same unit.

Briefly described, printing apparatus embodying the invention for printing either from type elements or dot elements comprises a carrier having a plurality of printing elements including a plurality of type characters and a plurality of dot elements, at successive positions spaced along a print line. This carrier may be an endless print band. Inasmuch as both full font type characters and dot elements are assembled on the same band, it may be referred to as a hybrid full font and dot matrix print band. The printing apparatus may also be referred to as hybrid full font and dot matrix printing apparatus. A plurality of movable hammers for impacting the printing elements are spaced from each other along the print line by a distance greater than the spacing or pitch of the characters and elements along the print line. The plurality of hammers is preferably assembled in a bank and movable together along the print line. A plurality of stationary armatures are spaced successively along the print line. Each armature spans a plurality of the successive positions of the printing element. The armatures are movable into and out of striking engagement with the hammers for selectively impacting the type character elements when they are located at character spacings along the print line and for striking and impacting the dot elements, when they are located at spacings closer than the character spacings, to form and print dot matrix characters.

The foregoing and other objects, features and advantages of the invention as well as a presently preferred embodiment thereof will become more apparent from a reading of the following description in connection with the accompanying drawings in which:

FIG. 2 is a sectional view of the apparatus shown in FIG. 1, the section being taken along the line 2—2 which is shown in FIG. 1;

FIG. 2A is a fragmentary sectional view taken along the line 2A—2A in FIG. 2;

FIG. 2B is an exploded view showing the parts which attach the hammer shuttle to the hammer belt;

FIG. 3 is an exploded, perspective view of a typical hammer assembly which is used in the apparatus shown in FIGS. 1 and 2;

FIG. 4 is a fragmentary perspective view illustrating in greater detail the hybrid full font character and dot matrix element print band which is used in the apparatus shown in FIGS. 1 and 2.

Figure 1:
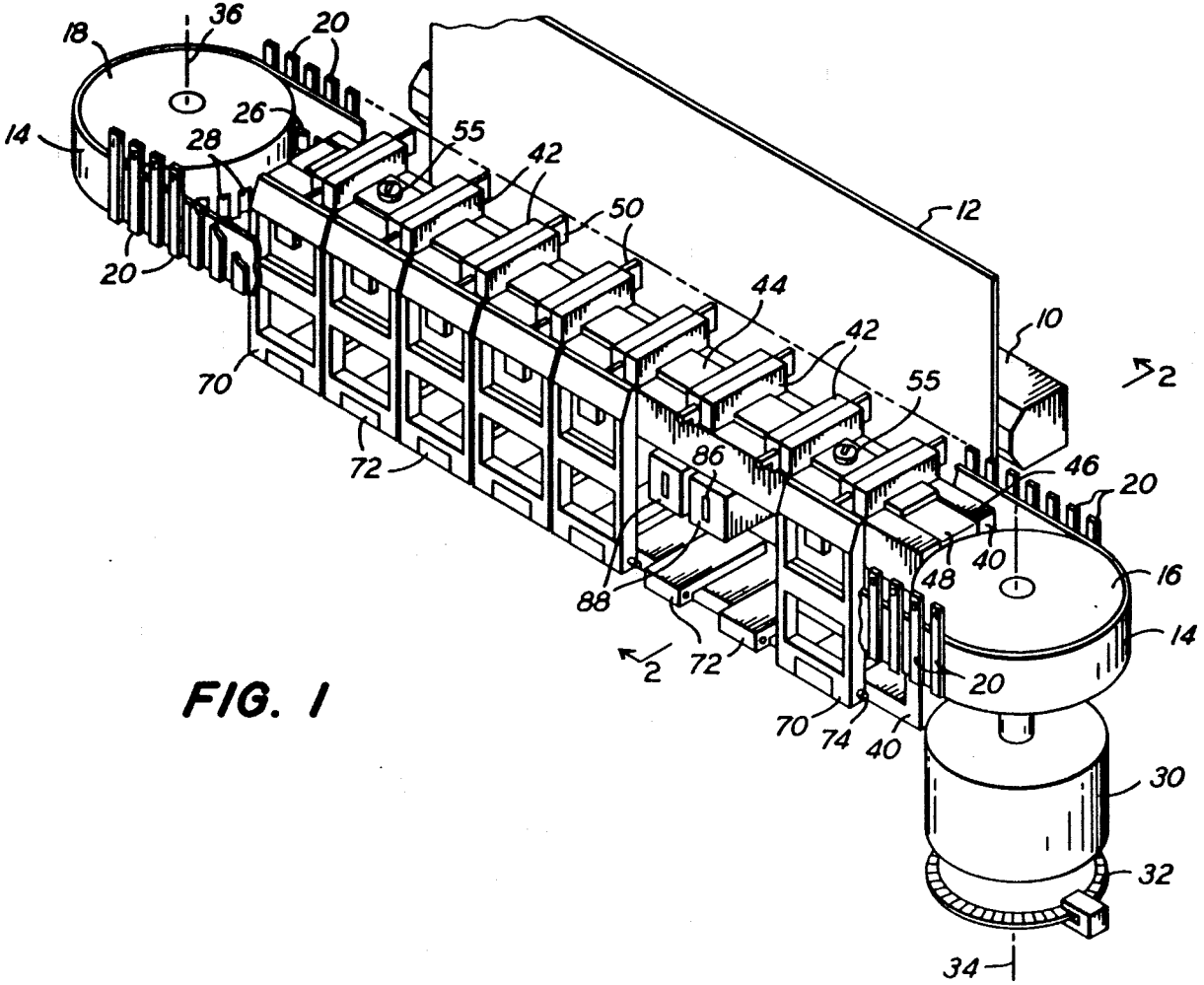
FIG. 1 is a perspective, pictorial representation illustrating printing apparatus embodying the invention.

Referring more particularly to the drawings there is shown, especially in FIG. 1, a platen 10 past which a sheet of paper 12 is transported. A print line extends horizontally along the platen 10. The base and support structure for the platen and other portions of the printer are not shown, since they may be of a conventional design. The paper 12 may be transported by tractor or other feed mechanisms as is conventional.

A printing element carrier or print band 14 is mounted on drums or pulleys 16 and 18 so as to be driven along a reach which extends along the print line opposite to the platen 10. A plurality of printing elements are carried at the upper ends of fingers 20 which are mounted on the belt. The spacing of the characters is uniform, i.e. the pitch of the printing elements is constant. As can be seen from FIGS. 1, 2 and 4 the fingers 20 contain both full font characters, such as the characters for the letters "X", "Y" and "Z" shown in FIG. 4, or they may contain dot printing elements which are spaced vertically from each other, such that when combined they provide a matrix from which different character shapes may be formed. It will be appreciated also that the use of different dots in different positions, coordinated with the feeding of the paper, may provide graphics printing, such as of charts and curves. The fingers project above the upper edge 22 of the band. The printing elements are located on the outside of the fingers 20 in the portion thereof which projects above the edge 22 of the band.

The band is preferably of material which has a high tensile strength and a high substantially constant modulus of elasticity. Materials of the type conventionally used for print bands may be suitable. However, it is preferred to use plastics having the aforementioned characteristics. Polyamide plastic films of the type used in document feed tractors (see Hubbard, U.S. Pat. No. 3,825,162 issued July 23, 1974) and polyester materials may also be suitable. The polyamide materials are sold under the tradename Kapton and polyester materials are sold under the tradename Mylar by the E.I. DuPont de Nemours Company of Wilmington, Delaware, U.S.A.

The fingers which carry the printing elements are desirably made of plastic or metal having resilience as well as durability. Nylon is presently preferred. These fingers may be assembled to the belt 14 by molding them through the belt as described in the above-referenced Hubbard patent or by insert molding or mechanical attachment. The fingers then lie against the outer surface of the band 14, the finger material flows through holes 24 to form lugs 26 on the inside surface of the belt 14. These lugs are preferably hemicylindrical in shape and are received in receptacles or slots 28 in the pulleys 16 and 18, much like the lugs on a tractor belt are received in the receptacles between the teeth of a sprocket of a document feed tractor. Reference may be had to the above-identified Hubbard patent for further information as to the belt drive systems used in document feed tractors. The use of fingers molded through a polyamide belt is presently preferred, since such belts are capable of being moved at high speeds with precision and can be produced and sold at costs which are very competitive with print bands of the type which are commercially available.

One of the pulleys 16 is a drive pulley and the other pulley 18 is an idler pulley. The idler pulley 18 is preferably spring loaded to tension the belt 14. The drive pulley is driven by a constant speed motor 30. An optical disc and sensor arrangement 32 on the shaft of the motor 30 provides data as to the position and displacement of the printing elements. The axes of the belt 14, which are defined by the axes 34 and 36 of the pulleys 16 and 18, are perpendicular to the print line.

As shown in FIG. 2, the platen 10 and the paper 12 are in impact receiving position with the printing elements of the fingers 20. A ribbon 38, which may be mounted in a ribbon cartridge in which an endless loop of ribbon is packed, is located between the printing elements and the paper and travels along the print line. The ribbon 38 is, of course, impacted by the printing elements as each line is printed.

An elongated block or body member 40 within the print band 14 and spaced between the pulleys 16 and 18 supports and guides a bank of hammer assemblies 42. The hammer assemblies are mounted on a shuttle which is provided by a base strip 44 which is captured in a groove 46 in the block 40. The assemblies may fit into notches 63 in the strip. The strip 44 provides the shuttle or carriage which is connected to a belt 48 (see also FIG. 5) so that the hammer bank 42 can move as a unit. Each hammer is spaced from the other by a plurality of character spacing positions. For example, in the illustrated printer 8 hammers are used. The illustrated printer may be an 80-column printer and the hammers are 10 columns or character positions apart.

As best shown in FIGS. 2, 2A, 2B, and 3 the hammer assemblies 42 include bars 50 which are slidably mounted and contained in bodies 52 and 54 which are screwed or ultrasonically welded together. A return spring 56 is captured in a notched region of the bar 50. A pocket 58 is formed between the bodies 52 and 54 when they are assembled together to receive the spring 56. The spring 56 biases the bodies 50 away from the print line (to the left as shown in FIG. 2).

The bodies 52 and 54 may be force-fit onto the strip 44 and secured by mechanical means (such as bolts 61 or ultrasonic welds) during assembly and located in the precise space relationship (10 columns apart as discussed above in the herein illustrated exemplary printer). The strip 44 and the belt 48 are captured in the slot 46 by two arrangements each of a bolt 55 and shouldered spacer 57. The locations of these two arrangements will be apparent from the locations of the bolts 55 in FIGS. 1 and 5. The slot 46 communicates with another slot 59 which widens into a slot 60. These spacers 57 are of a diameter less than the width of the slots 59 and 60 in the block 40 in which they are disposed. The lower end 53 of the spacer may be square to prevent the spacer from turning when the bolt 55 is screwed into it. There is sufficient clearance provided by the spacer 57 to enable the captured strip 44 and belt 48 to slide in the block 40. The block 40 and the shuttle or carriage bar 44 are suitably made of polycarbonate resin with Teflon or glass filler particles. The belt 48 is suitably made of Kapton or Mylar. The sliding friction is sufficiently low so as not to interfere with the reciprocal movement of the bank of hammer assemblies 42 on the base strip 44 in the groove 46.

The bar 50 in each of the hammer assemblies has a width narrower than the width of the fingers so that it will impact only one finger at a time. Between revolutions of the print band 14, the bank of hammer assemblies 42 is moved, either towards the left or right along the print line, so as to bring the bars 50 of each of the hammers into a position adjacent to the position it occupied during the previous revolution. The displacements of the bank of hammers is therefore at most one printing element pitch per revolution of the belt. The displacement can be less than a printing element pitch when dot matrix characters are to be printed. Assuming, for example, that the dot matrix has ten columns per character, the hammer bank may move one-tenth of a full character pitch displacement between successive print band revolutions. Thus each hammer, in an 80-column printer and of course the entire bank will move a maximum of 100 steps; 10 when printing full font characters and 100 when printing dot matrix characters having 10 columns per matrix. It will be appreciated that there will be printing going on at 8 character positions during each revolution, as the bars 50 of the hammer assemblies 42 impact against the fingers 20 on the print band 14. Printing therefore is carried out at high speed, for example, 250 to 500 characters per second in an 80-column printer.

Figure 5:
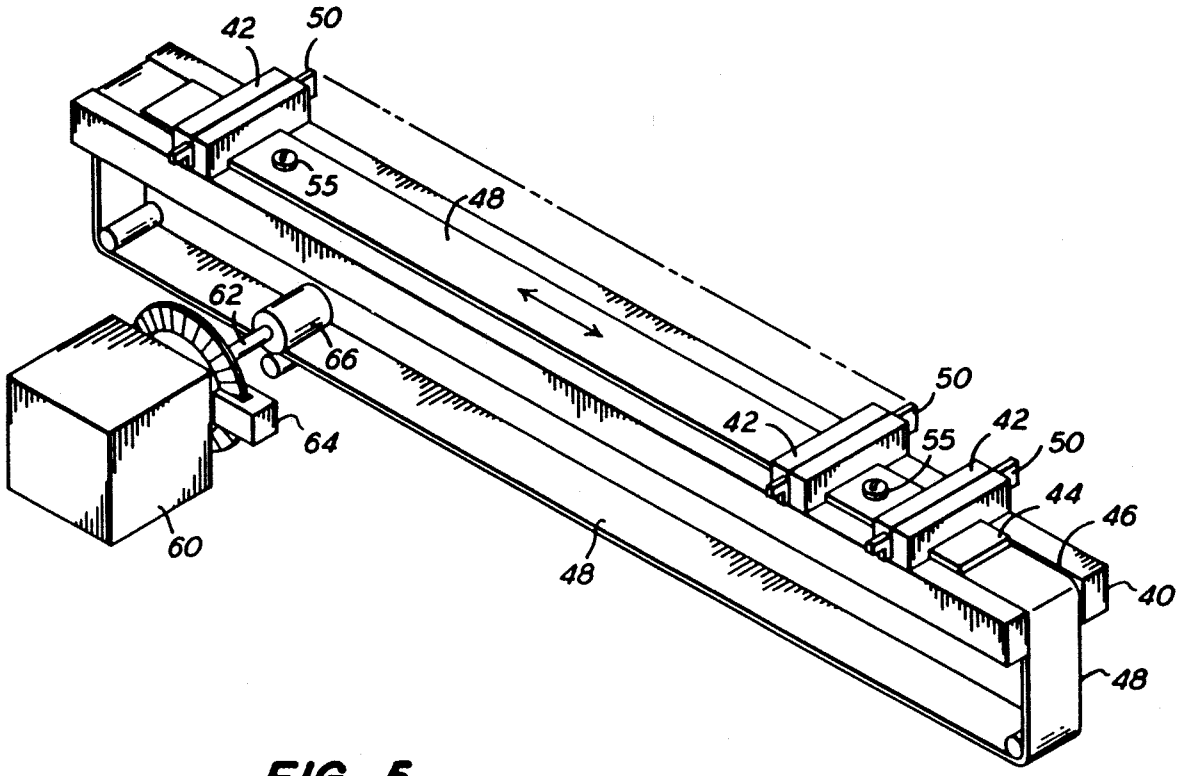
FIG. 5 is a perspective, pictorial representation of the mechanism utilized in the printing apparatus illustrated in FIGS. 1 and 2 for moving the bank of hammers along the print line.

In order to move the bank of hammers, the belt 48, which is attached to the strip 44 which is attached to each of the hammer assemblies 42, is driven by means of a motor 60 which is connected to a shaft 62 (see FIG. 5). The shaft 62 carries an optical disc and sensor arrangement 64 similar to the arrangement 32 used on the shaft of the sensor motor 30 (FIG. 1). The belt 48 can be driven over its discrete displacements by a timing belt and pulley arrangement 66 attached to the shaft 62 of the motor 60. The motor 60 may be a stepper motor. In order to provide the very small displacements required, the shaft 62 may be connected to the motor by way of a reduction gear mechanism, such as uses a worm gear and worm wheel. Instead of a timing belt and pulley arrangement 66, a drum may be connected to the end of the shaft 62 and a cable which is connected to the belt 48 wound in a level wind (non-overlapping turns) on the drum. Then the cable is wound in one direction in order to move the bank of hammer assemblies 42 to the right and in the opposite direction in order to move the bank to the left.

The bars 50 of the hammer assemblies (see FIGS. 1 and 2) are impacted by armatures 70 which are pivotally mounted on members 72 which project from the base block 40. The pivots may be pins 74 which provide a sufficiently long and stiff shaft so as to restrict the armatures 72 against tilting about a plane perpendicular to the axes of the pins 74. The armatures have surfaces 76 which impact against the rear ends of the hammer bars 50. The surfaces extend over the entire hammer pitch distance. For example the width of each of the 8 armatures 72 in the illustrated printer are 10 columns wide. A spring is captured in axially aligned holes in the base block 40 and in each of the armatures 70. The spring 78 (see FIG. 2) biases the armature 70 against a stop 80. A bar 82 supports the stops for each of the armatures 70. The armatures are preferably made of light material, for example polycarbonate and have a iron cross piece or strip 84 attached thereto in alignment with yokes 86 of an electromagnetic field structure. The yokes 86 are fixed in the base block 40 and are generally u-shaped. Coils 88 around the legs of the yoke 86 provide the magnetic field.

When these coils are actuated, the armatures 74 are magnetically attracted and drive the hammer bars 50. The bars then impact against the printing element fingers 20 and cause printing to be carried out by pressing the ribbon 38 and paper 12 against the platen 10.

Character location in time without requiring machine timing of the belt 14 with respect to the pulley 16 may be accomplished through the use of projections, such as a finger or a plurality of fingers spaced along the belt 14, the passage of which is detected by stationary detectors mounted on the block 40.

Using the pulses from the sensor 32 and from the sensor 34, both the hammer bank and the character band may be synchronized in their movement so as to effectuate printing on the fly either in character pitch spaced positions or in sub-pitch displaced positions for full font or dot matrix character printing, respectively. Conventional line printer control and driving logic, timed and synchronized with pulses from the sensors 32 and 64, may be used to select either characters or dot elements from the band 14 for printing.

Variations and modifications in the herein described printing apparatus, within the scope of the invention, will undoubtedly suggest themselves to those skilled in the art. Accordingly, the foregoing description should be taken as illustrative and not in a limiting sense.

I claim:

1. Printing apparatus for printing either from type elements or dot elements at successive positions spaced along a print line, which apparatus comprises a carrier having a plurality of printing elements including a plurality of type character elements and a plurality of dot elements at positions spaced on said carrier from each other along said print line, each element comprising either a single character or dot, said dot elements further being vertically spaced from each other, means for driving said carrier along said print line, a plurality of hammers for impacting said printing elements, said hammers being spaced from each other along said print line by distances greater than the spacing of said characters, means for moving said hammers together along said print line selectively by different distances corresponding to said character positions and said dot positions, respectively, a plurality of stationary armatures spaced successively along said print line, each armature spanning a plurality of said successive positions and being movable in a direction into and out of engagement with said hammers for selectively impacting said type character elements when they are located at character spacings along said print line and said dot elements when they are located at spacings closer than said character spacings to form dot matrix characters with said dot elements.

2. Printing apparatus according to claim 1 further comprising means for synchronizing the movement of said hammers and said carrier.

3. Printing apparatus according to claim 1 further comprising means for moving said hammers a distance along said print line less than the width along said print line of each of said armatures.

4. Printing apparatus according to claim 1 wherein said carrier is an endless belt.

5. Printing apparatus according to claim 1 wherein said hammers each comprise an assembly of a bar having a width only sufficient to impact a single printing element at one time, guides in which said bars are mounted for reciprocal movement transverse to said print line, and said means for moving said hammers including a shuttle movable along said print line on which said guides are mounted.

6. Printing apparatus according to claim 5 wherein said means for moving said hammers further includes means movable along said spring line and attached to said shuttle for translating said shuttle along said print line.

7. Printing apparatus according to claim 6 wherein said carrier is an endless belt and said shuttle translating means is a belt or cable, said carrier belt and shuttle belt or cable being movable about axes which are perpendicular to each other.

8. Printing appartaus for printing either from type elements or dot elements at successive positions spaced along a print line which comprises a carrier having a plurality of printing elements including a plurality of type character elements and a plurality of dot elements at positions spaced along said print line, means for driving said carrier along said print line, a plurality of hammers for impacting said printing elements, said hammers being spaced from each other along said print line a distance greater than the spacing of said characters and being movable together along said print line, a plurality of stationary armatures spaced successively along said print line, each armature spanning a plurality of said successive positions and being movable in a direction into and out of engagement with said hammers for selectively impacting said type character elements when they are located at character spacings along said print line and said dot elements when they are located at spacings closer then said character spacings to form dot matrix characters with said dot elements, said hammers each comprising an assembly of a bar having a width only sufficient to impact a single printing element at one time, guides in which said bars are mounted for reciprocal movements transverse to said print line and a shuttle movable along said print line on which said guides are mounted, means movable along said print line and attached to said shuttle for translating said shuttle along said print line, said carrier being an endless belt and said shuttle translating means being a belt or cable, said carrier belt and shuttle belt or cable being movable about axes which are perpendicular to each other, spaced pulleys having axes perpendicular to said print line on which said carrier belt is mounted for movement along a path between said pulleys paralleling said print line, a block disposed between said pulleys, said block having a groove paralleling said pring line, said shuttle being disposed in said groove, said shuttle belt or cable being disposed around said body, said armatures being pivotally mounted to said body, and electromagnetic means for actuating said armatures mounted in said body.

9. Printing apparatus according to claim 8 further comprising motor means connected in driving engagement with at least one of said pulleys on which said carrier belt is mounted, separate motor means for driving said shuttle belt, and means responsive to the rotation of said motors for providing outputs whereby the movement of said shuttle and said carrier belt and the actuations of said armatures can be synchronized so as to print characters along said print line.

10. A printing element carrier for use in a line printer having at least one drive pulley, said pulley having receptacles therein, said receptacles being spaced along the periphery of said pulley, and said carrier comprising an endless belt with a width dimension between opposite edges thereof, said belt having a plurality of printing elements disposed on flexible fingers attached to said belt wherein said fingers are molded through said belt to define drive lugs on the inside of said belt, which lugs are spaced for engagement with the receptacles of said drive pulley, and to locate said fingers on and disposed against the outside of said belt and extending across the width of said belt with said printing elements above one of the opposite edges of said belt.

11. The carrier as set forth in claim 10 wherein said printing elements comprise type printing elements and dot printing elements.

12. The carrier as set forth in claim 10 wherein said printing elements comprise type printing elements.

13. The carrier as set forth in claim 10 wherein printing elements comprise dot printing elements.

14. The carrier as set forth in claim 10 wherein said elements are of plastic material.

15. The carrier as set forth in claim 14 wherein said plastic material is nylon.

* * * * *